US006475034B1

(12) United States Patent
Zhang et al.

(10) Patent No.: US 6,475,034 B1
(45) Date of Patent: Nov. 5, 2002

(54) ELECTRICAL CONNECTOR

(75) Inventors: Guo Zeng Zhang, Kunsan (CN); GuangXing Shi, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/013,385

(22) Filed: Dec. 7, 2001

(51) Int. Cl.[7] ..... H01R 13/648
(52) U.S. Cl. ..... 439/607; 439/364
(58) Field of Search ..... 439/607–610, 439/79, 364

(56) References Cited

U.S. PATENT DOCUMENTS 5,603,639 A * 2/1997 Lai et al. ..... 439/607
5,871,373 A * 2/1999 Pacini et al. ..... 439/364
6,074,218 A * 6/2000 Wu et al. ..... 439/607
6,227,880 B1 * 5/2001 Zhu et al. ..... 439/607

* cited by examiner

*Primary Examiner*—Hien Vu
(74) *Attorney, Agent, or Firm*—WeiTe Chung

(57) ABSTRACT

An electrical connector is fixed to a panel (7) of a notebook computer includes an insulative housing (1) forming two mating sections (12), a plurality of contacts (2) retained in the housing (1), a metal pad (5) and a shielding device. The housing (1) includes a protrusion (13) which has a front face (131) defining a locating hole therein. The shielding device includes two front shells (3) surrounding the mating sections (12) and a rear shell (4). Tabs (32*a*) extend from the front shells (3) and each defines a hole (32*b*) therein. The metal pad (5) is mounted to the protrusion, including a body section (52) retained in the locating hole (13*a*) of the housing (1) and defining an inner-threaded hole (53). A bolt (8) extends through a through hole (71) defined in the panel (7) and the holes (32*b*) of the front shells (3) in sequence and then engages the inner-threaded hole (53) of the pad (5) for securing the connector to the panel (7).

5 Claims, 7 Drawing Sheets

ELECTRICAL CONNECTOR

BACKGROUND OF THE INVENTION

1. Field of the Invention

The present invention relates to an electrical connector, and more particularly to a Universal Serial Bus (USB) connector having a fixing device which secures the connector to a panel of an electrical device.

2. Description of the Related Art

Universal Serial Bus (USB) connectors are often used to connect peripheral devices, such as Hard Disk Drive (HDD) and Compact Disc-Read Only Memory (CD-ROM), to electrical devices such as a desktop computer and a notebook computer. A conventional USB connector is shown in FIG. 7 of the attached drawings, comprising a first shell 101, a second shell 103, an insulative housing 102 enclosed by the first shell 101, and a plurality of conductive contacts 104 retained in the insulative housing 102. The insulative housing 102 comprises a base section 1021, a pair of mating sections 1022 extending from the base section 1021 and a protrusion 1023 formed between the mating section 1022.

However, the connector shown in FIG. 7 is not securely fixed, when a mating connector is inserted into the connector, an insertion force induced by the mating connector and acting upon the connector may cause undesired movement of the connector, resulting in poor mating between the two connectors. Such an undesired movement of the connector may even break the electrical connection between the connector and the PCB on which the connector is mounted. Hence, it is desired to improve the electrical connector in order to overcome the disadvantages thereof.

SUMMARY OF THE INVENTION

Accordingly, it is an object of the present invention to provide an electrical connector which can be firmly fixed to a panel of an electrical device.

It is another object of the present invention to provide a fixing device of an electrical connector which can firmly fix the connector to a panel of an electrical device.

To achieve the above objects, an electrical connector in accordance with the present invention that can be fixed to a panel of an electrical device comprises an insulative housing, a plurality of conductive contacts, a shielding device and a metal pad. The insulative housing comprises a base section, two mating sections extending from the base section and a protrusion between the mating sections. Each mating section defines passageways for receiving the contacts. The protrusion has a front face with a locating hole formed therein. The shielding device comprises two front shells respectively surrounding the mating sections, and a rear shell enclosing the base section and engages the front shells. Each front shell forms a tab with a hole defined therein. The metal pad comprises a front plate overlapping the front face of the protrusion, a body section extending from the front plate and received in the locating hole with an inner-threaded hole defined therein. A bolt extends through a through hole defined in a panel of the electrical device and the holes of the tabs of the front shells in sequence and then engages with the inner-threaded hole of the insulative housing thereby securing the electrical connector to the panel of the electrical device.

Other objects, advantages and novel features of the invention will become more apparent from the following detailed description of preferred embodiments thereof when taken in conjunction with the accompanying drawings, wherein:

DETAILED DESCRIPTION OF PREFERRED EMBODIMENTS

Figure 1:
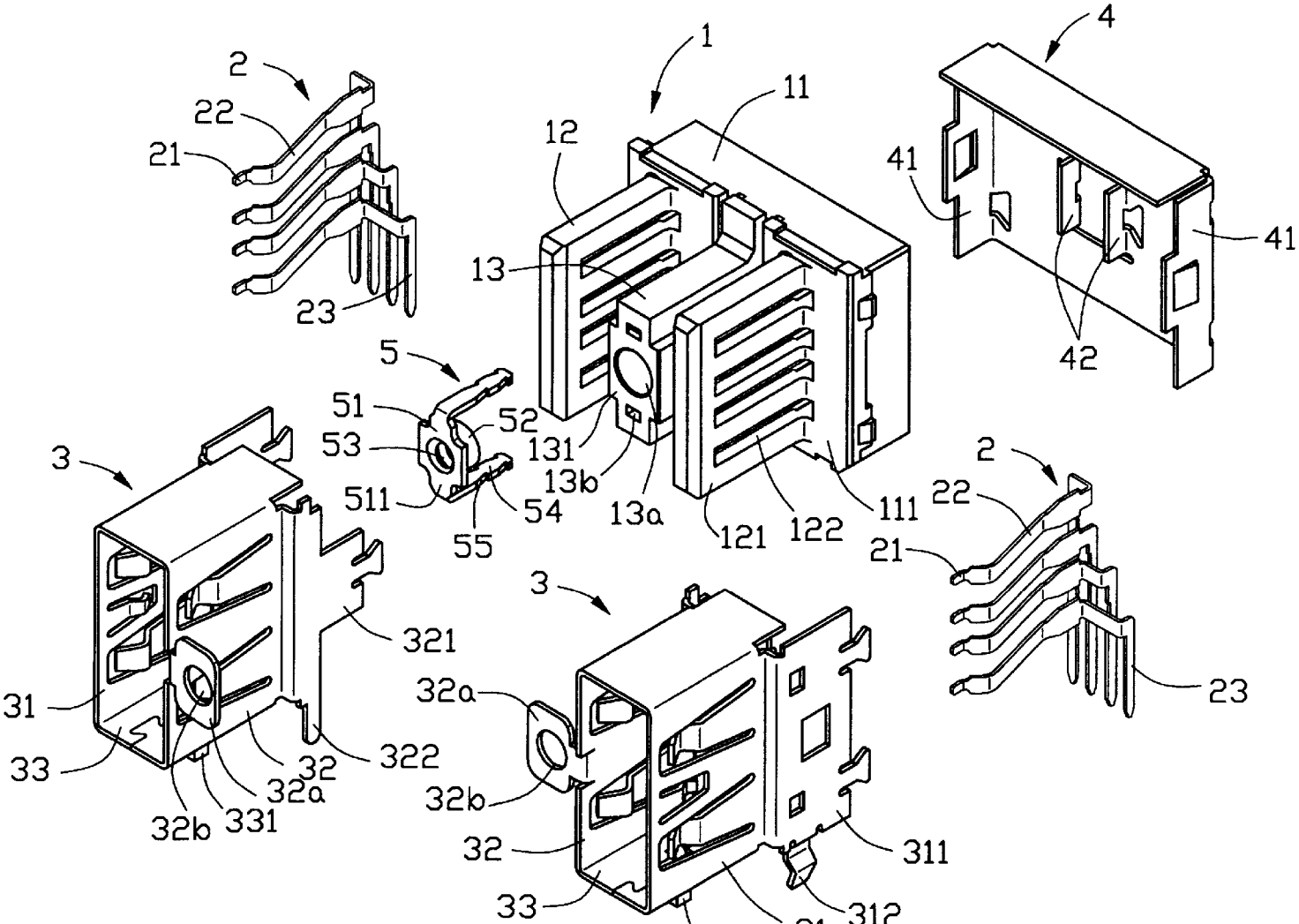
FIG. 1 is an exploded perspective view of an electrical connector in accordance with the present invention.
Figure 5:
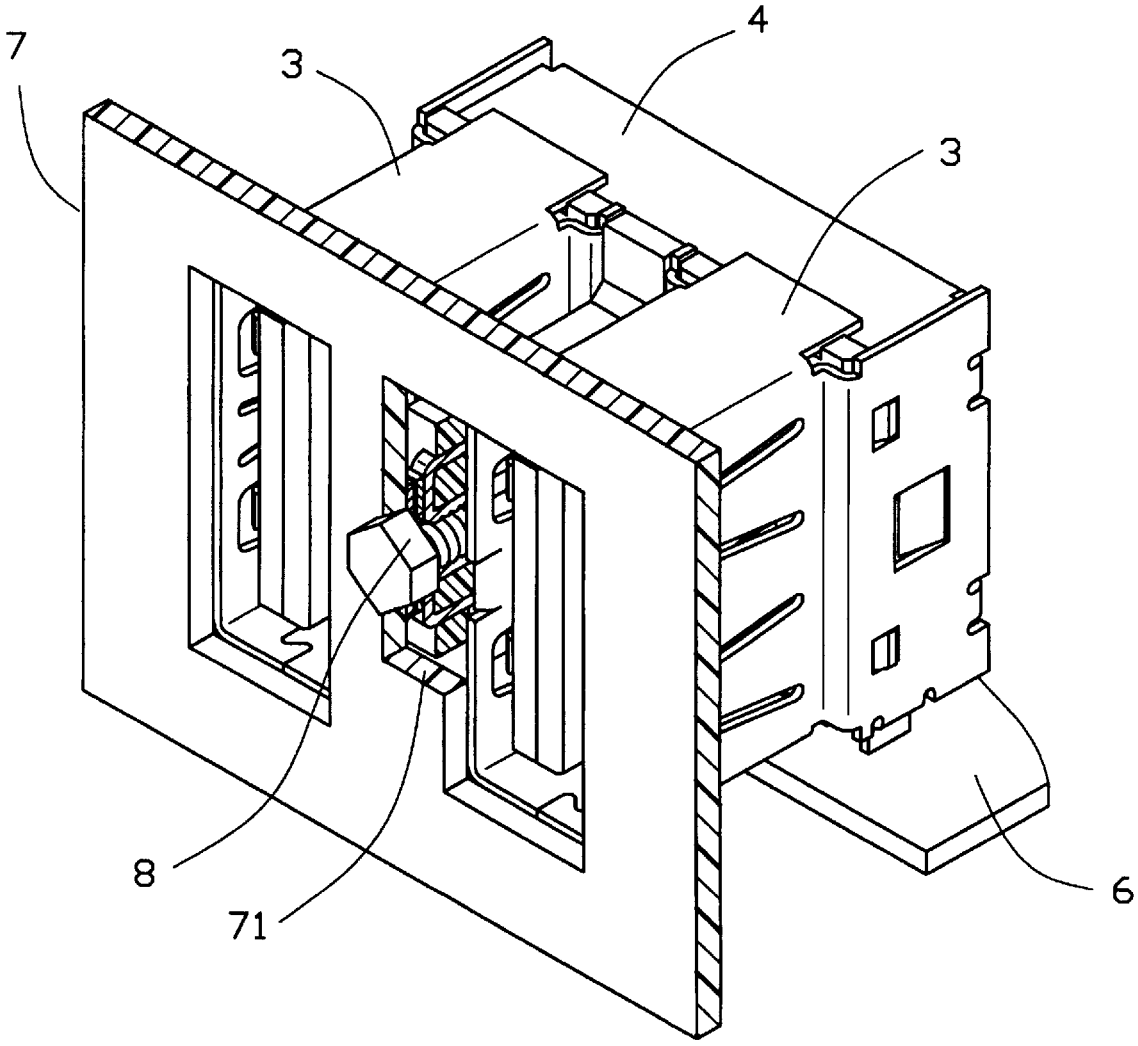
FIG. 5 is a perspective view showing the electrical connector of FIG. 1 mounted to a printed circuit board and a panel of a notebook computer.

Referring to FIGS. 1 and 5, an electrical connector in accordance with the present invention comprises an insulative housing 1, a plurality of conductive contacts 2, front and rear shells 3, 4, and a metal pad 5.

The insulative housing 1 comprises a base section 11 having a front face 111, and a pair of mating sections 12 forwardly extending from the base section 11 and a protrusion 13 between the mating sections 12. Each mating section 12 has opposite surfaces 121 defining a plurality of passageways 122 for receiving the contacts 2. The protrusion 13 has a front face 131 defining a locating hole 13*a*, and two retention holes 13*b* are defined in the face 131 on opposite sides of the locating hole 13*a*. The portion of the protrusion 13 that surrounds the locating hole 13*a* can be made larger than the rest of the protrusion 13 for reinforcement purposes.

Each contact 2 comprises a mating portion 21 for electrically engaging with a mating connector (not shown), a retaining portion 22 received in the passageways 122 of the housing 1, and a tail portion 23 extending from the retaining portion 22 for electrically connecting with a printed circuit board (PCB) 6 (FIG. 5).

The metal pad 5 is mounted to the front face 131 of the protrusion 13, comprising a front plate 51, a body section 52 extending from the front plate 51 and an inner-threaded hole 53 defined in the body section 52 for engaging with a bolt 8 (FIG. 5). The body section 52 is embedded in the locating hole 13*a* of the housing 1. Two retention legs 54, each having barbs 55, extends from the front plate 51 for engaging with the retention holes 13*b* of the protrusion 13 to secure the metal pad 5 to the housing 1.

The insulative housing 1, except the protrusion 13, is enclosed by shielding means comprising a front shell 3 surrounding each mating section 12 and a rear shell 4 covering the base section 11. Each front shell 3 has opposite outer side walls 31 and inner side walls 32, and a bottom wall 33 connecting the outer and inner side walls 31, 32. Rear side walls 311, 321 respectively downwardly extend from the outer side walls 31, 32. Supporting legs 312, 322 respectively downwardly extend from the rear side walls 311, 321. Another supporting leg 331 downwardly extends from the bottom wall 33 of the front shell 3. All the legs 312, 322 and 331 are insertable into corresponding holes (not shown) defined in the PCB 6.

A tab 32*a* extends away from the inner side walls 32 of each front shell 3. A holes 32*b* is defined in the tab 32*a* and aligned with the locating holes 13*a* for the extension of the bolt 8 (FIG. 5).

The rear shell 4 comprises opposite outer side walls 41 and inner side walls 42. Both of the outer and inner side walls 41, 42 respectively engage the rear side walls 311, 321 of the front shells 3 by means of coupling devices therebetween. The coupling devices can be of any known types.

Figure 2:
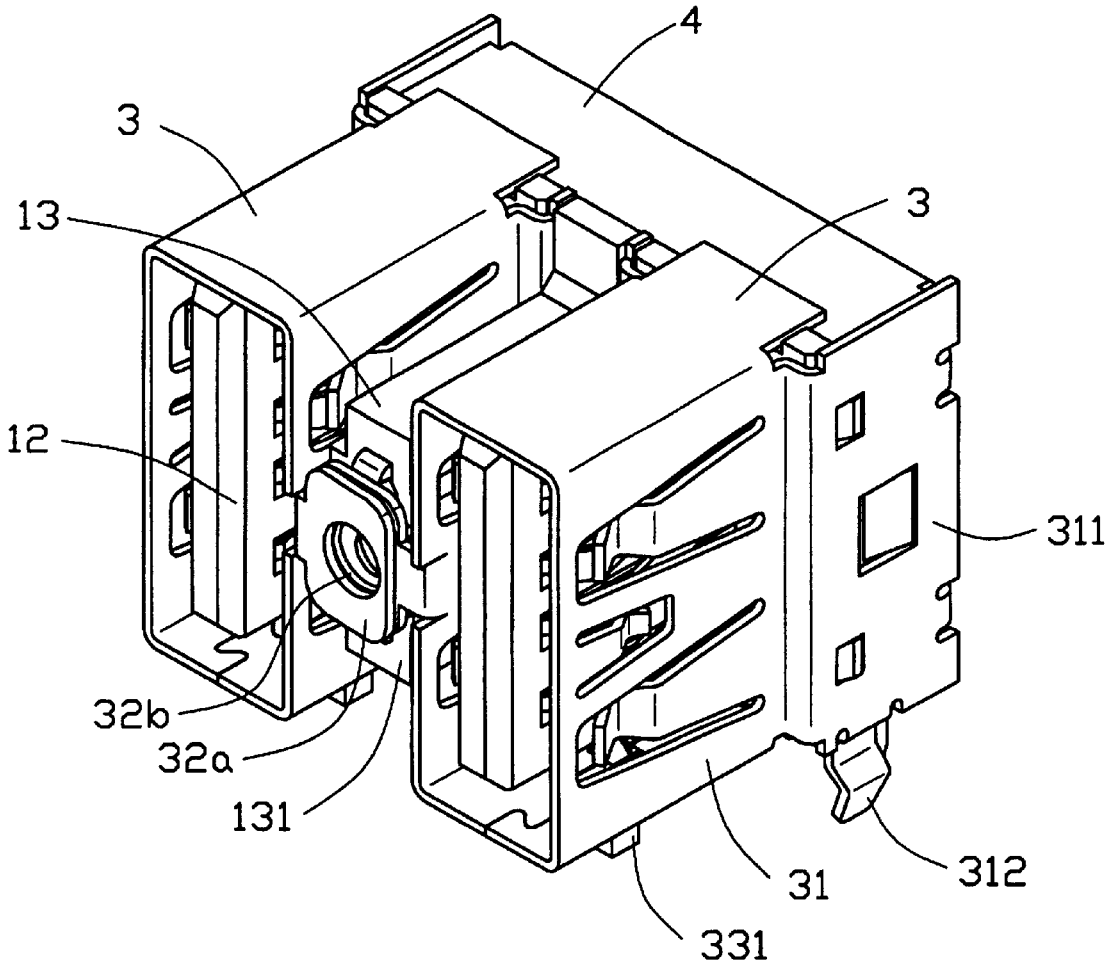
FIG. 2 is an assembled view of the electrical connector of FIG. 1.
Figure 3:
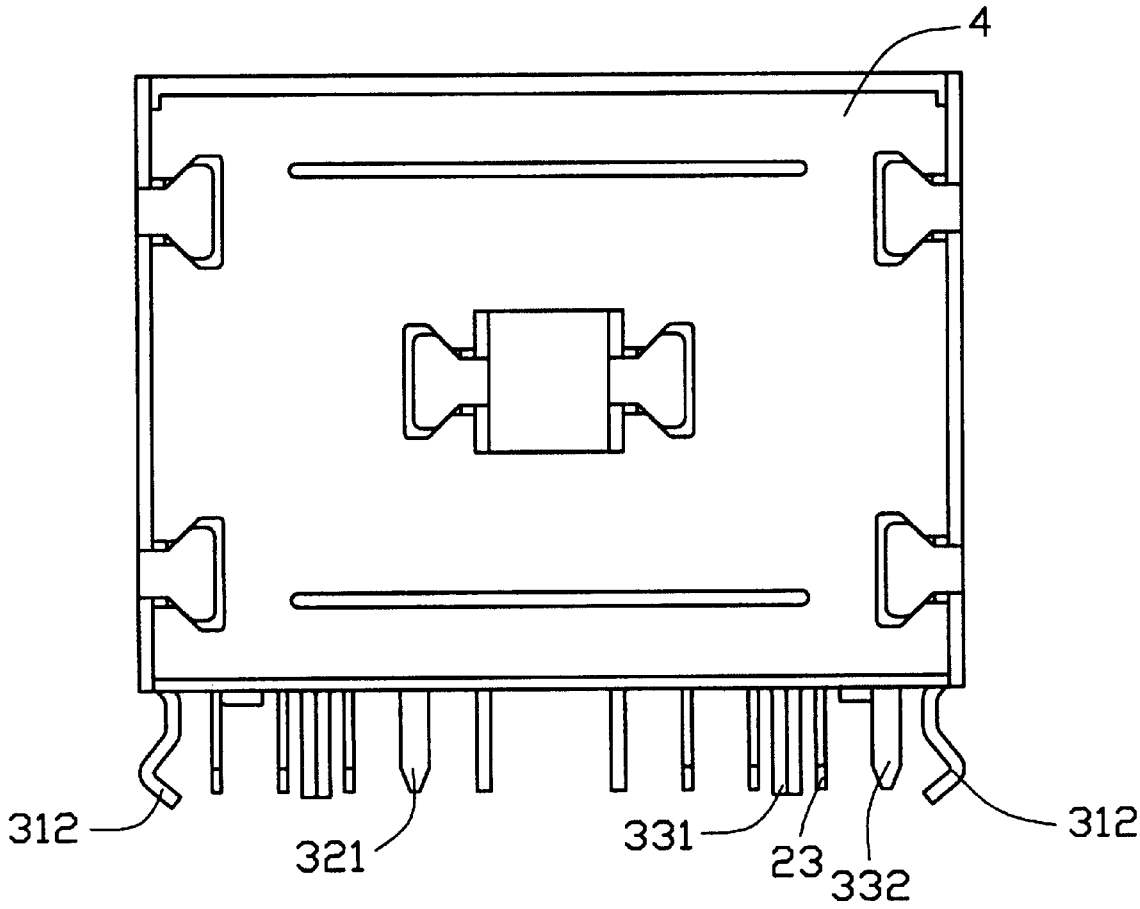
FIG. 3 is a rear view of the electrical connector of FIG. 1.
Figure 4:
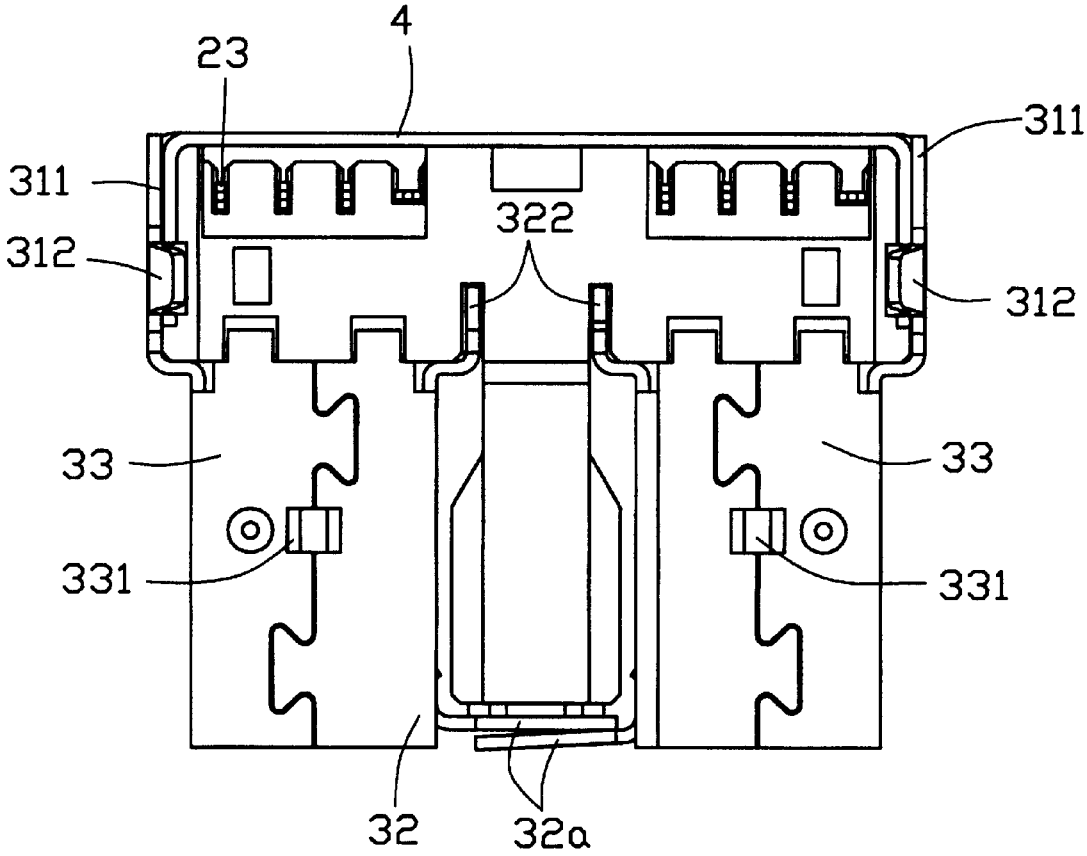
FIG. 4 is a bottom view of the electrical connector of FIG. 1.

Referring now to FIGS. 2, in assembly, the body section 52 and the retention legs 54 of the metal pad 5 are fit into the locating holes 13*a* and the retention holes 13*b* of the protrusion 13 of the housing 1 for properly positioning and securing the pad 5 to the housing 1. The front shells 3 surround the mating sections 12 of the housing 1. A space is formed between the mating section 12 and the front shells 3 for the insertion of the mating connector. The rear side walls 311, 321 of the each front shell 3 respectively engage with the corresponding outer side wall 41 and the inner side wall 42 of the rear shell 4. The tabs 32*a* of the front shells 3 overlap a front surface 511 of the front plate 51 of the pad 5 with the holes 32*b* aligned with the locating hole 13*a*.

FIG. 5 shows the electrical connector is mounted to a PCB 6 and a panel 7 of for example a notebook computer (not shown). When the electrical connector is mounted to the PCB 6, the tail portions 23 of the contacts 2 and the legs 312, 322 and 331 are respectively received in corresponding holes (not shown) defined in the PCB 6 for electrical and mechanical connection.

When the electrical connector is attached to the panel 7, the distance between the front face 131 of the protrusion 13 and the panel 7 is substantially equal to the overall thickness of the tabs 32*a* of the front shells 3 and the front plate 51 of pad 5. A bolt 8 extends through a through hole 71 of the panel 7 and the holes 32*b* in sequence and eventually engaging with the inner-threaded hole 55 of the pad 5 for securely attaching the connector to the panel 7.

Figure 6:
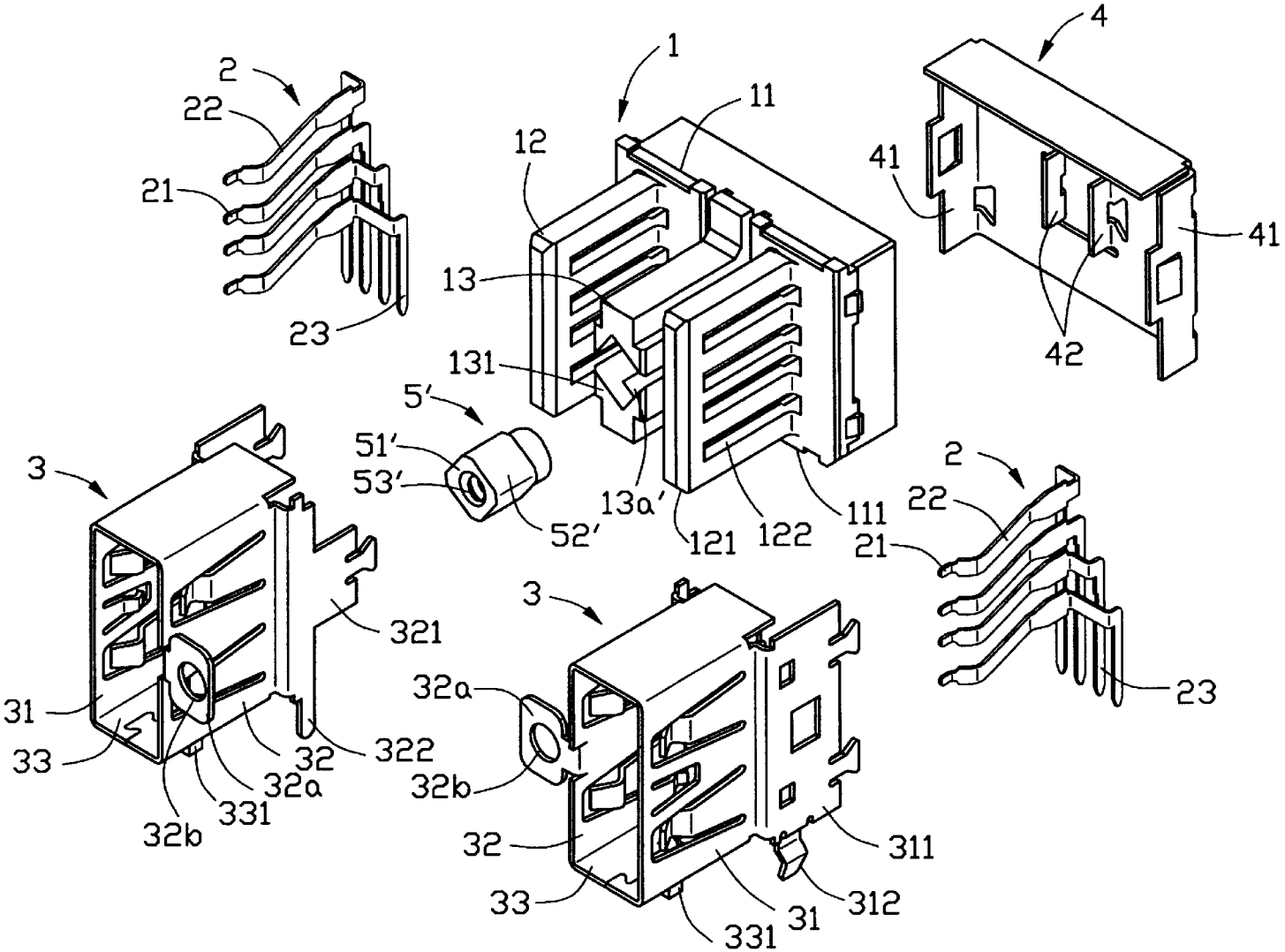
FIG. 6 is an exploded perspective view showing a second embodiment of the electrical connector in accordance with the present invention.
Figure 7:
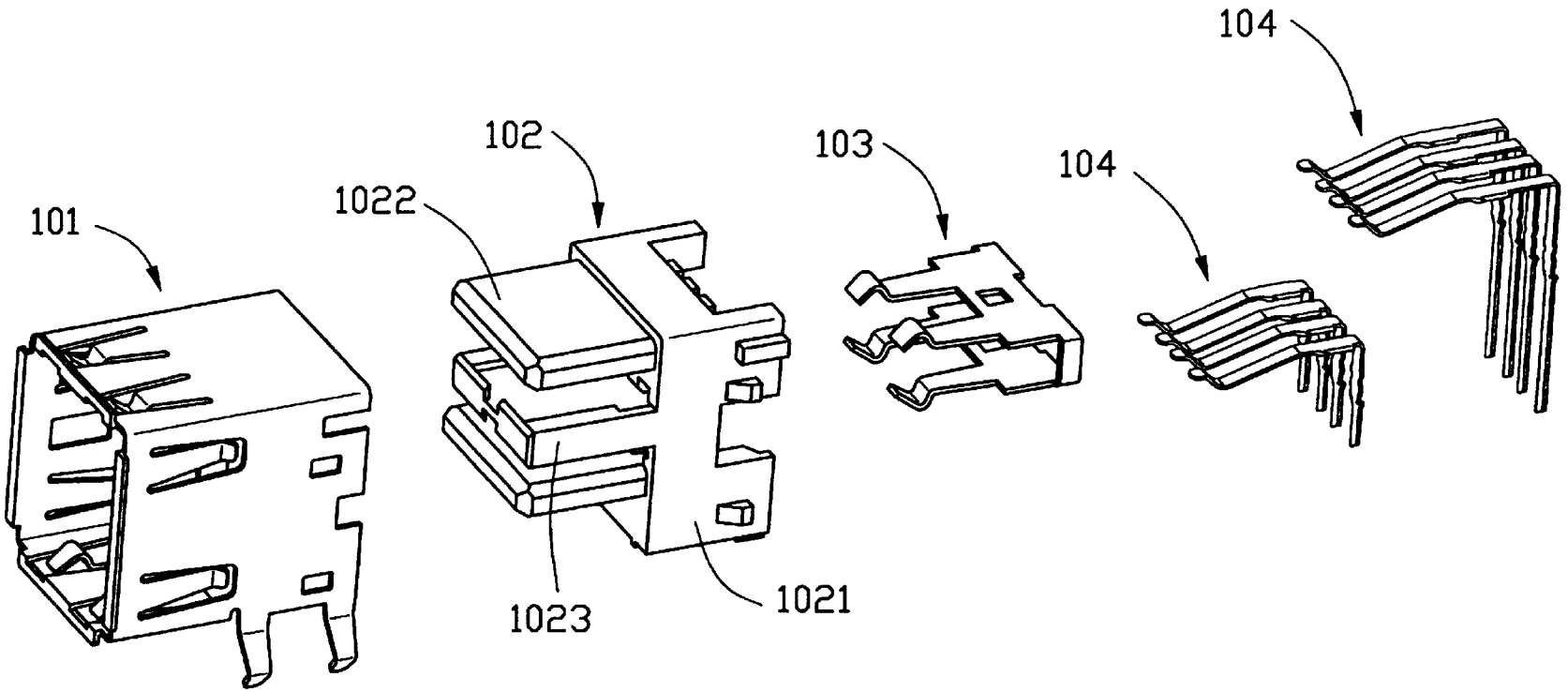
FIG. 7 (PRIOR ART)
FIG. 7 is an exploded perspective view of a conventional electrical connector.

FIG. 6 shows another embodiment of the connector in accordance with the present invention. The embodiment shown in FIG. 6 is in general similar to the embodiment discussed with reference to FIG. 1–5 with only the metal pad 5 replaced by a metal nut 5' in FIG. 6. The nut 5' comprises a body section 52' with an inner-threaded hole 53' defined in the body section 52'. A locating hole 13*a'* is defined in the front face 131 of the protrusion 13 of the insulative housing 1, having a shape complementary to the body section 52' of the nut 5' for receiving and securely retaining the nut 5' therein. The locating hole 13*a'* can be arranged in an inclined fashion for space saving purposes.

It is to be understood, however, that even thought characteristics and advantages of the present invention have been set forth in the foregoing description, together with details of the structure and function of the preferred embodiments of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector adapted to be mounted to a panel of an electrical device, comprising:

an insulative housing comprising a pair of mating sections each defining a plurality of passageways and a protrusion having a front face defining a locating hole therein;

a plurality of the contacts received in the passageways of the mating section of the insulative housing;

a fastening member fixed to the protrusion and comprising a body section received in the locating hole of the insulative housing, the body section defining an inner-threaded hole;

a shielding device shielding the housing, comprising a tab extending from a front end of the shielding device and positioned on the fastening member, a hole being defined in the tab and substantially aligned with the inner-threaded hole of the fastening member for extension of a bolt that extends through a hole defined in the panel and matingly engaging with the inner-threaded hole of the body section; wherein the insulative housing comprises a base section and said pair of mating sections extending from the base section, the protrusion extending from the base section and between the mating sections; wherein the shielding device comprises front shells surrounding each mating section and a rear shell enclosing the base section and engaging with the front shells.

2. The electrical connector as claimed in claim 1, wherein the front shells have opposite inner side walls and outer side walls, each inner side wall forming a tab positioned on the fastening member and defining a hole substantially aligned with the inner-threaded hole of the fastening member.

3. The electrical connector as claimed in claim 1, wherein the fastening member comprises a nut.

4. An electrical connector assembly comprising:

an insulative housing defining mating sections with a plurality of contacts therein, and a mating direction;

a metal shielding enclosing said mating sections, a tab laterally extending from a front edge of said shielding;

a protrusion formed on the housing between the mating sections and beside said shielding with a front face having a locating hole therein;

a fastening member fixed to the front face of the protrusion and received in the locating hole in said mating direction; and a panel defining openings aligned with the mating sections and an aperture, beside said openings, aligned with the fastening member in said mating direction; wherein a bolt extends, along said mating direction, through all the aperture, the tab and the fastening member for not only securing the housing to the panel but also the shielding thereto.

5. The assembly as claimed in claim 4, wherein another shielding includes another tab through which said bolt extends for retaining said another shielding to the panel.

* * * * *